US010955198B2

(12) United States Patent
Oono

(10) Patent No.: US 10,955,198 B2
(45) Date of Patent: Mar. 23, 2021

(54) FIN-ASSEMBLED TUBE

(71) Applicant: Marelli Cabin Comfort Japan Corporation, Saitama (JP)

(72) Inventor: Hiroyuki Oono, Saitama (JP)

(73) Assignee: Marelli Cabin Comfort Japan Corporation, Saitama (JP)

( * ) Notice: Subject to any disclaimer, the term of this patent is extended or adjusted under 35 U.S.C. 154(b) by 0 days.

(21) Appl. No.: 16/343,623

(22) PCT Filed: Nov. 7, 2017

(86) PCT No.: PCT/JP2017/040117
§ 371 (c)(1),
(2) Date: Apr. 19, 2019

(87) PCT Pub. No.: WO2018/088396
PCT Pub. Date: May 17, 2018

(65) Prior Publication Data

US 2020/0056847 A1 Feb. 20, 2020

(30) Foreign Application Priority Data

Nov. 11, 2016 (JP) ..... JP2016-220486

(51) Int. Cl.

| | |
|---|---|
| ***F28F 1/14*** | (2006.01) |
| ***F28F 1/40*** | (2006.01) |
| ***F28F 21/08*** | (2006.01) |
| *B21D 7/12* | (2006.01) |
| *F28D 9/00* | (2006.01) |
| *F28F 13/12* | (2006.01) |

(52) U.S. Cl.
CPC ..... *F28F 1/40* (2013.01); *F28F 21/08* (2013.01); *B21D 7/12* (2013.01); *F28D 9/0062* (2013.01); *F28F 13/12* (2013.01); *F28F 2215/10* (2013.01)

(58) Field of Classification Search
CPC ..... F28F 1/40; F28F 1/36; F28F 13/12; F28F 21/08; F28F 2215/10; B21C 37/26; B21D 39/04; B21D 9/04; B21D 9/05; B21D 7/12; F28D 9/0062; F28D 7/10
USPC ..... 165/154, 155, 156
See application file for complete search history.

(56) References Cited

U.S. PATENT DOCUMENTS 5,251,603 A * 10/1993 Watanabe ..... F02M 31/20 123/541

FOREIGN PATENT DOCUMENTS

| | | | |
|---|---|---|---|
| JP | S4868257 | U | 8/1973 |
| JP | S6298985 | U | 6/1987 |
| JP | S62268994 | A | 11/1987 |
| JP | S63190779U | U | 12/1988 |
| JP | H01101092 | U | 7/1989 |

(Continued)

*Primary Examiner* — Henry T Crenshaw
*Assistant Examiner* — Kamran Tavakoldavani
(74) *Attorney, Agent, or Firm* — Young Basile Hanlon & MacFarlane, P.C.

(57) ABSTRACT

A fin-assembled tube includes a helical fin arranged in an interior of a tube, wherein the tube has: a straight tube portion the center line of which extends in a substantially straight line; and a bent portion the center line of which is curved, and the helical fin is formed such that a helical pitch in an axial direction is longer in a portion positioned in the bent portion relative to the helical pitch in a portion positioned in the straight tube portion, the helical pitch being a pitch of a plate-shaped fin material twisted by a certain angle about the center line.

4 Claims, 8 Drawing Sheets

(56) References Cited

FOREIGN PATENT DOCUMENTS

| | | | | | |
|---|---|---|---|---|---|
| JP | H0236782U | U | | 3/1990 | |
| JP | H11720 | A | | 1/1999 | |
| JP | 2008070045 | A | * | 3/2008 | ..... F28F 1/32 |
| JP | 2011-027285 | A | | 2/2011 | |
| JP | 2011027285 | A | * | 2/2011 | ..... F28F 13/12 |
| WO | 2011055408 | A1 | | 5/2011 | |

* cited by examiner

FIN-ASSEMBLED TUBE

CROSS-REFERENCE TO RELATED APPLICATION(S)

This application claims priority to Japanese Application Serial No. 2016-220486, filed Nov. 11, 2016, the entire disclosure of which is hereby incorporated by reference.

TECHNICAL FIELD

The present invention relates to a fin-assembled tube in which a helical fin is arranged in an interior of a tube.

BACKGROUND

JP62-268994A discloses a heat exchanger in which a helical plate is installed in an interior of a heat-conducting tube.

When the above-described heat exchanger is manufactured, a long plate is twisted in advance to form the helical plate, and thereafter, the helical plate is arranged in the interior of the heat-conducting tube.

During the manufacture of the above-described heat exchanger, a bending process may be performed such that the heat-conducting tube is curved.

However, because a flexural rigidity of a curved bent portion is not uniform due to a position of the helical plate interposed in the interior of the heat-conducting tube, there is a risk in that the above-described heat-conducting tube is not formed into the designed shape.

SUMMARY

An object of the present invention is to increase a forming accuracy of a bent portion in a fin-assembled tube.

According to one aspect of the present invention, a fin-assembled tube including a helical fin arranged in an interior of a tube, wherein the tube includes: a straight tube portion a center line of which extends in a substantially straight line; and a bent portion the center line of which is curved, and the helical fin is formed such that a helical pitch in an axial direction is longer in a portion positioned in the bent portion relative to the helical pitch in a portion positioned in the straight tube portion, the helical pitch being a pitch of a plate-shaped fin material twisted by a certain angle about the center line.

According to the above-described aspect, in the bent portion of the tube, because the helical pitch of the helical fin is longer than that of the straight tube portion, it is possible to suppress a variation in a flexural rigidity of the helical fin. Thus, it is possible to increase a forming accuracy of the bent portion in the fin-assembled tube.

DETAILED DESCRIPTION

Embodiments of the present invention will be described below with reference to the attached drawings.

Figure 1:
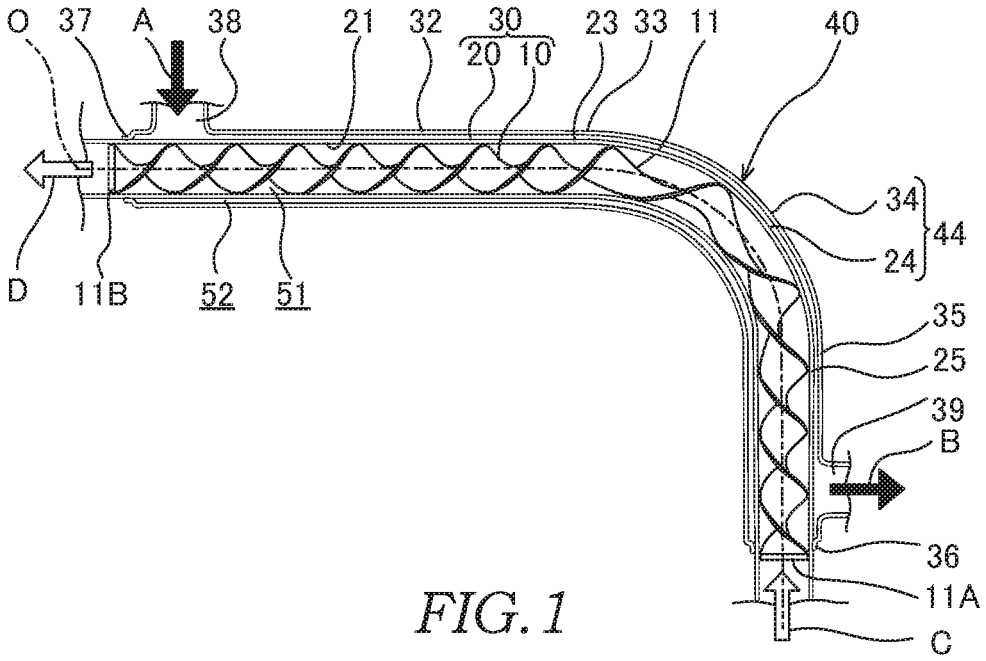
FIG. 1 is a sectional view showing a double tube according to an embodiment of the present invention.

FIG. 1 is a sectional view showing a double tube 40 to which a fin-assembled tube 30 (a heat exchange tube) according to this embodiment is applied. The double tube 40 is provided as a heat exchanger for an air-conditioning device (not shown) through which refrigerant (fluid) circulates.

The double tube 40 is provided with a cylindrical inner tube 20 forming an inner flow channel 51 in an interior thereof and a cylindrical outer tube 32 that forms an outer flow channel 52 around the inner tube 20. Pipes (not shown) for guiding the refrigerant are connected to both end portions of the inner tube 20. Both end portions 36 and 37 of the outer tube 32 are joined to an outer circumference of the inner tube 20. The outer tube 32 has an inlet 38 and an outlet 39 to which pipes (not shown) for guiding the refrigerant are connected.

As shown by arrows A and B in the figure, high-temperature-high-pressure liquid refrigerant flows through the outer flow channel 52 via the inlet 38 and the outlet 39. As shown by arrows C and D in the figure, low-temperature-low-pressure gaseous refrigerant flows through the inner flow channel 51. In the double tube 40, a heat exchange takes place between the refrigerants flowing through the outer flow channel 52 and the inner flow channel 51.

A helical fin 10 is arranged in the interior of the inner tube 20. As described later, the helical fin 10 is formed by twisting a strip-shaped fin material 11 into a helical shape. Both end portions 11A and 11B of the fin material 11 are fixed to an inner surface 21 of the inner tube 20 by, for example, crimping.

Respective members 32, 20, and 10 forming the double tube 40 are made of metals such as aluminum, etc., for example.

The inner tube 20 and the helical fin 10 form the fin-assembled tube 30 as a component of the heat exchanger. In the fin-assembled tube 30, the refrigerant flowing through the inner flow channel 51 flows by swirling helically along the helical fin 10, and thereby, the heat exchange via the inner tube 20 is facilitated for the refrigerant.

The double tube 40 has a curved portion 44 that is formed by curving a middle region thereof so as to adapt to a space in which the double tube 40 is to be mounted. The inner tube 20 has a bent portion 24 that forms the curved portion 44 and straight tube portions 23 and 25 that extend in a straight line from the bent portion 24. The outer tube 32 has a bent portion 34 that forms the curved portion 44 and straight tube portions 33 and 35 that extend in a straight line from the bent portion 34.

Next, a manufacturing apparatus 50 of the fin-assembled tube 30 will be described with reference to FIG. 2.

The manufacturing apparatus 50 includes a core rod 60 that is inserted into the interior of the inner tube 20, a chuck 70 that holds the outer circumference of the inner tube 20, and a bending machine 80 that supports the outer circumference of the inner tube 20 in a freely slidable manner to perform a bending process.

The manufacturing apparatus 50 includes an actuating mechanism 65 for actuating the core rod 60 and an actuating mechanism 75 for actuating the chuck 70. As shown by an arrow E, the actuating mechanism 65 rotationally actuates the core rod 60 about an axis O of the inner tube 20, and at the same time, as shown by an arrow F, moves the core rod 60 in the axis O direction. As shown by an arrow H, the actuating mechanism 75 moves the chuck 70 in the axis O direction. Operation of the actuating mechanisms 65 and 75 and the bending machine 80 is controlled by a controller (not shown).

The bending machine 80 includes a bend die 81, a pressure die 82, and a clamp die 83. The bend die 81 has a forming groove 81A that extends in an arc shape centered at a bending center axis S. The pressure die 82 has a guide groove 82A that extends in the axis O direction. The inner tube 20 is supported between the forming groove 81A and the guide groove 82A in a freely slidable manner and is guided so as to move in the axis O direction. The clamp die 83 has a clamp groove (not shown) for holding the outer circumference of the inner tube 20.

During the bending process, the bend die 81 and the clamp die 83 are rotated by an actuating mechanism (not shown) about the bending center axis S in a state in which the inner tube 20 is held between the bend die 81 and the clamp die 83. With such a configuration, the inner tube 20 that has been sent out by the actuating mechanism 75 is bent so as to follow the forming groove 81A.

The core rod 60 has a columnar base end portion 62 extending in the axis O direction, a support portion 63, and a tip-end portion 64. The core rod 60 also has a slit 61 that opens over between the support portion 63 and the tip-end portion 64.

The base end portion 62 of the core rod 60 is a portion to be linked to the actuating mechanism 65.

The support portion 63 of the core rod 60 is a portion to support the tip-end portion 64 with respect to the base end portion 62. The support portion 63 is formed so as to have a diameter smaller than those of the base end portion 62 and the tip-end portion 64 and extends in the axis O direction such that a gap is formed between the support portion 63 and the inner surface 21 of the inner tube 20. With such a configuration, sliding resistance of the core rod 60 is suppressed.

Figure 3:
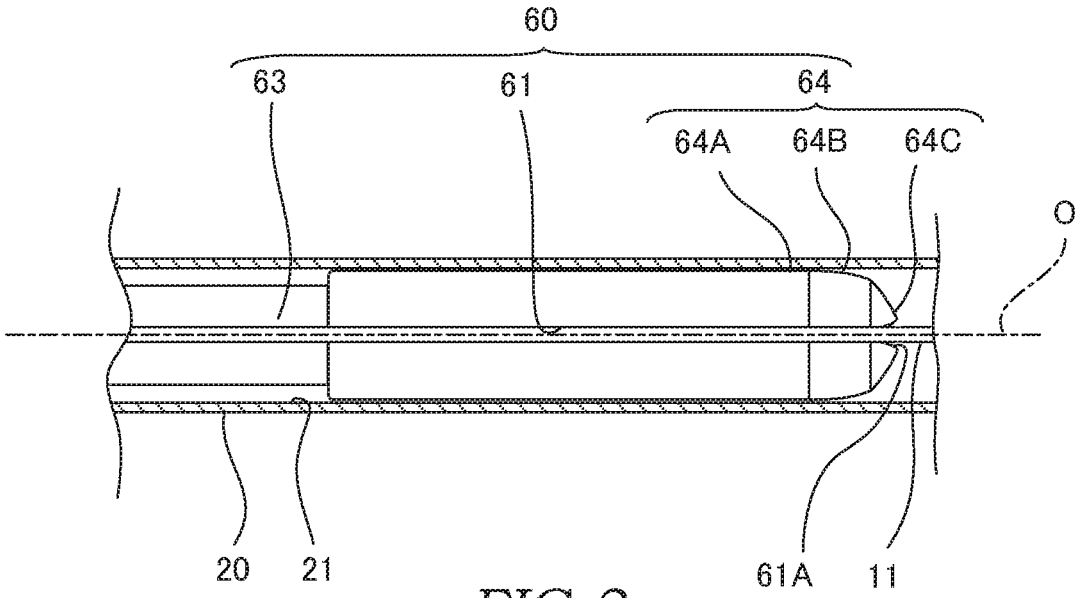
FIG. 3 is a plan view showing a core rod.

As shown in FIG. 3, the tip-end portion 64 has a die portion 64A that is brought into sliding contact with the inner surface 21 of the inner tube 20, and a die tip-end portion 64B and a tip-end relief portion 64C that extend such that the diameters are decreased gradually from the die portion 64A in the axis O direction.

The die portion 64A is formed to have a columnar shape. An outer circumferential surface of the die portion 64A faces the inner surface 21 of the inner tube 20 with a gap between the die portion 64A and the inner surface 21. As described later, the die portion 64A is configured such that, during the bending process, the bent portion 24 is formed as the die portion 64A is brought into contact with the inner surface 21 of the inner tube 20 in the vicinity of the bent portion 24 while being rotated relatively.

The die tip-end portion 64B is formed to have a spindle shape a diameter of which is decreased from the die portion 64A without having irregularities. An outer circumferential surface of the die tip-end portion 64B extends from the outer circumferential surface of the die portion 64A so as to form a round surface without being bent. As described later, the die tip-end portion 64B is configured such that, during the bending process, the bent portion 24 is formed as the die tip-end portion 64B is brought into contact with the inner surface 21 of the bent portion 24 while being rotated relatively.

The tip-end relief portion 64C projects from the die tip-end portion 64B such that its diameter is reduced further. As described later, the tip-end relief portion 64C is configured so as not to interfere with the inner surface 21 of the bent portion 24 during the bending process.

The slit 61 is a gap that extends in the axis O direction so as to have a constant opening width and that forms a support wall portion that supports the fin material 11 received in the core rod 60. An open end portion 61A of the slit 61 opens at the tip-end relief portion 64C such that the opening width is increased gradually.

Next, a method of manufacturing the fin-assembled tube 30 using the manufacturing apparatus 50 will be described.

Figure 2:
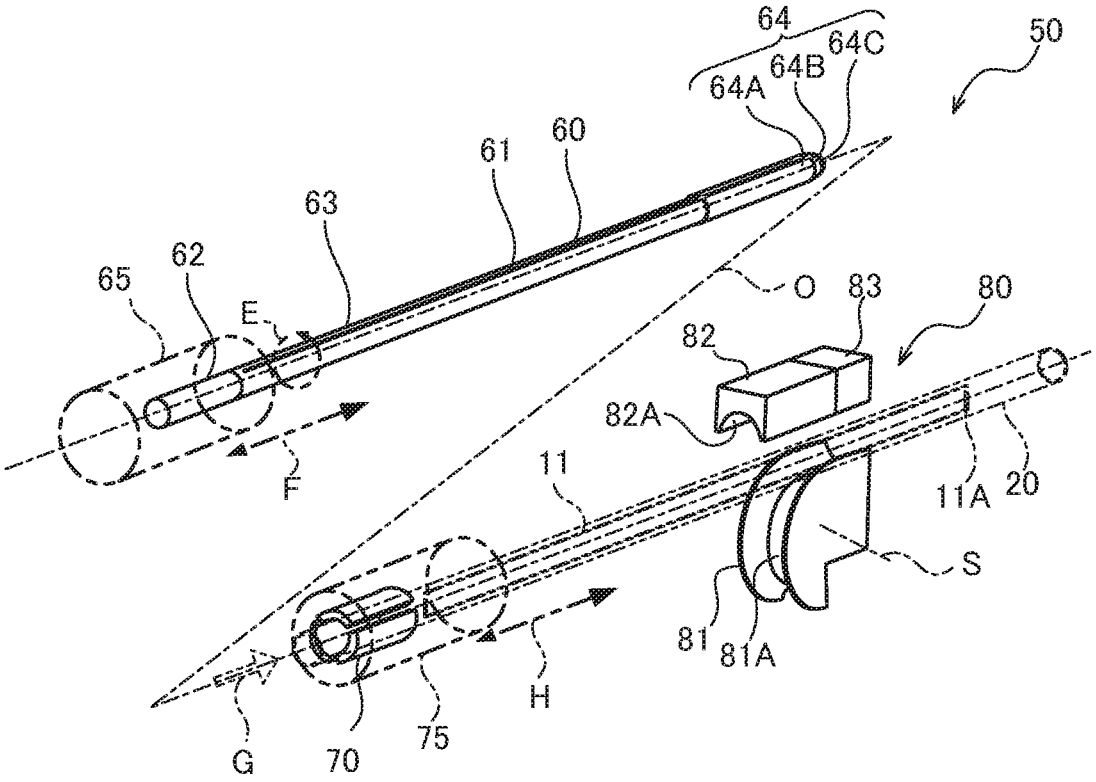
FIG. 2 is a perspective view showing a manufacturing apparatus of a fin-assembled tube.

As shown by an arrow G in FIG. 2, the fin material 11 is first inserted into the inner tube 20. Next, a tip-end portion 11A of the fin material 11 is fixed to the inner tube 20 by crimping the outer circumference of the inner tube 20.

Here, the configuration is not limited to the one described above, and it may be possible to employ a configuration in which, for example, the tip-end portion 11A of the fin material 11 is fixed to the inner tube 20 by press-fitting the tip-end portion 11A to the inner surface 21 of the inner tube 20.

Figure 4:
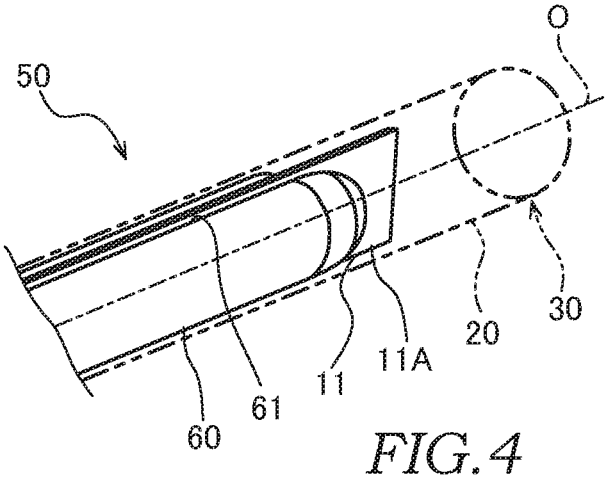
FIG. 4 is a perspective view showing a step of manufacturing the fin-assembled tube.

Then, as shown in FIG. 4, the core rod 60 is inserted into the inner tube 20. At this time, the fin material 11 is inserted into the slit 61 of the core rod 60.

Figure 5:
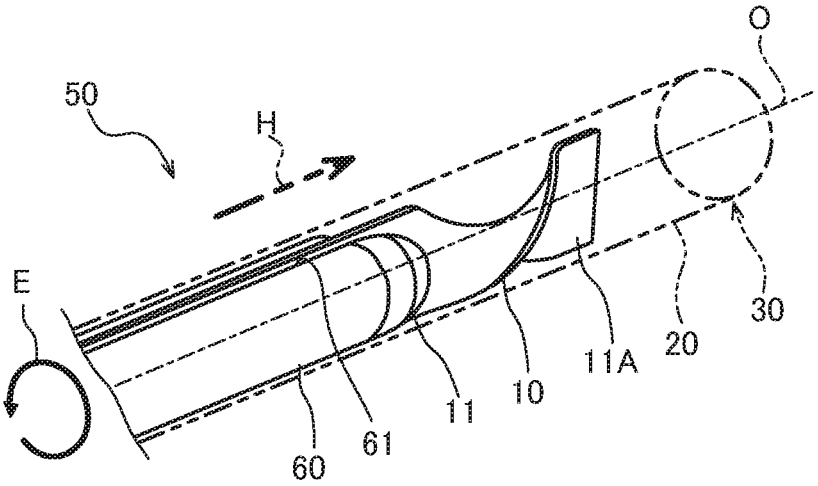
FIG. 5 is a perspective view showing a step of manufacturing the fin-assembled tube.
Figure 6:
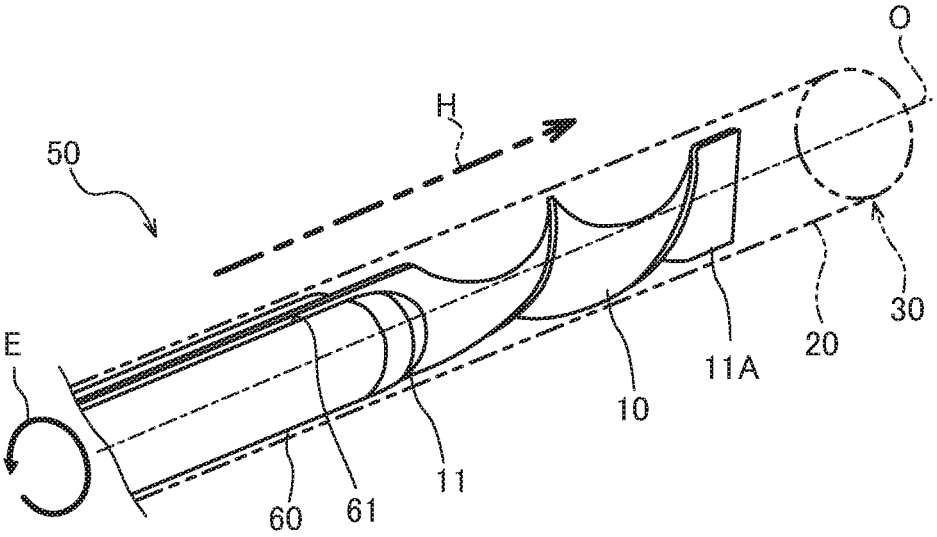
FIG. 6 is a perspective view showing a step of manufacturing the fin-assembled tube.

Thereafter, as shown by the arrow H in FIGS. 5 and 6, the inner tube 20 is moved in the axis O direction with respect to the core rod 60, and at the same time, as shown by the arrow E in FIGS. 5 and 6, the core rod 60 is rotated in one direction with respect to the inner tube 20.

By doing so, the fin material 11 being pulled out of the slit 61 of the core rod 60 is twisted by utilizing the tip-end portion 11A as a supporting point. By doing so, the helical fin 10 is formed in the interior of the straight tube portion 25 of the inner tube 20.

Figure 7:
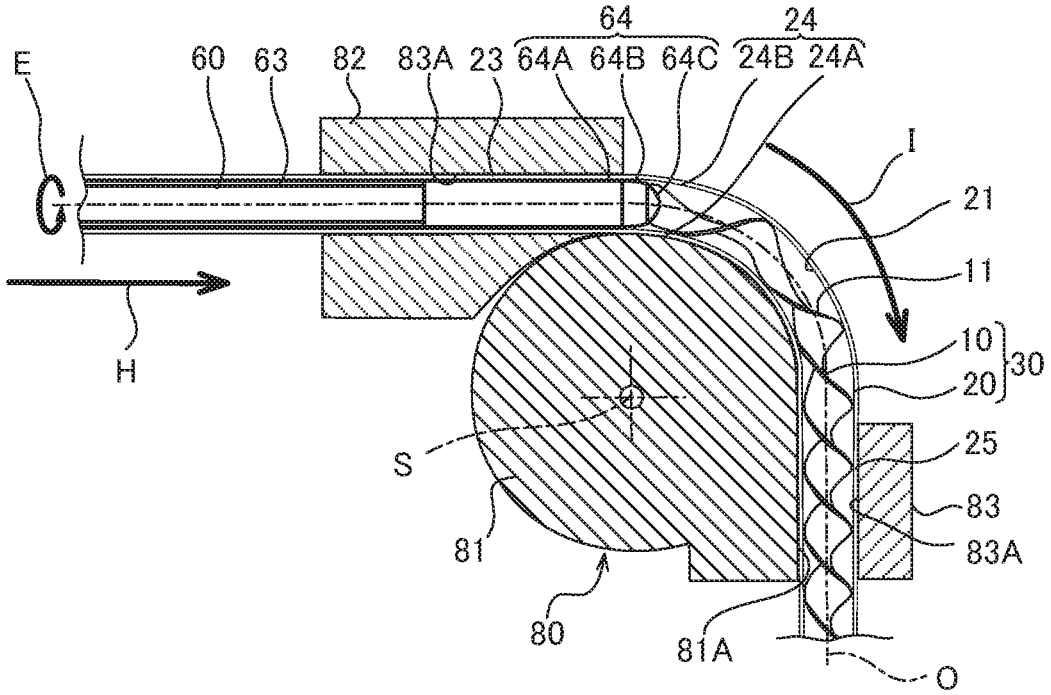
FIG. 7 is a sectional view showing a step of manufacturing the fin-assembled tube.

Next, as shown in FIG. 7, the bending machine 80 is operated to bend the inner tube 20. At this time, as shown by an arrow I, the bend die 81 and the clamp die 83 are rotated about the bending center axis S while holding the inner tube 20. By doing so, the inner tube 20 sent out by the actuating mechanism 75 as shown by the arrow H is bent so as to follow the arc-shaped forming groove 81A.

During the above-described bending process, in the inner tube 20, the bent portion 24 is formed as an outer circumference of the tip-end portion 64 of the core rod 60 is brought into contact with the inner surface 21 of the inner tube 20.

During the above-described bending process, although compressive stress is produced at a curved inner-side portion 24A positioned on the inside-corner side of the bent portion 24, because the columnar die portion 64A is brought into contact with the inner surface 21 of the inner tube 20 in the vicinity of the curved inner-side portion 24A, occurrence of buckling is suppressed. With such a method, occurrence of forming failures such as wrinkles, etc. is suppressed in the curved inner-side portion 24A.

During the above-described bending process, although tensile stress is produced at a curved outer-side portion 24B positioned on the outside-corner side of the bent portion 24, because the spindle-shaped die tip-end portion 64B is brought into contact with the inner surface 21 of the inner tube 20 while being rotated relatively, an arc-shaped cross-sectional shape of the curved outer-side portion 24B is maintained. With such a method, formation of a portion having excessively flattened cross-sectional shape is suppressed in the curved outer-side portion 24B.

During the above-described bending process, the controller performs a control such that the rotating speed of the core rod 60 rotated by the actuating mechanism 65 as shown by the arrow E is reduced with respect to the moving speed of the inner tube 20 sent out by the actuating mechanism 75 in the axis O direction as shown by the arrow H. By doing so, the helical fin 10 is formed such that a length in the axis O direction at which the fin material 11 is twisted by a certain angle about the axis O (hereinafter, referred to as "a helical pitch") becomes longer in the bent portion 24 relative to those in the straight tube portions 23 and 25.

After the above-described bending process is performed, the clamp die 83 that has been holding the inner tube 20 is moved to an escape position by the bending machine 80. Then, the core rod 60 is rotated while the inner tube 20 is moved in the axis O direction relatively to the core rod 60, and thereby, the helical fin 10 is formed in the interior of the straight tube portion 23 of the inner tube 20.

Next, the base end portion 11B of the fin material 11 is fixed to the inner tube 20 by crimping the outer circumference of the inner tube 20.

As described above, the fin-assembled tube 30 is manufactured. Both end portions of the outer tube 32 are joined to the inner tube 20 before a step of manufacturing the above-described fin-assembled tube 30. In addition, it may be possible to employ a configuration in which one end portion of the outer tube 32 is joined to the inner tube 20 before the step of manufacturing the fin-assembled tube 30, and the other end portion of the outer tube 32 is joined to the inner tube 20 after the step of manufacturing the fin-assembled tube 30. In both cases, in the manufacturing apparatus 50, the inner tube 20 and the outer tube 32 are subjected to the bending process together by using the bending machine 80. In FIG. 7, for the sake of convenience, illustration of the outer tube 32 is omitted.

Figure 8:
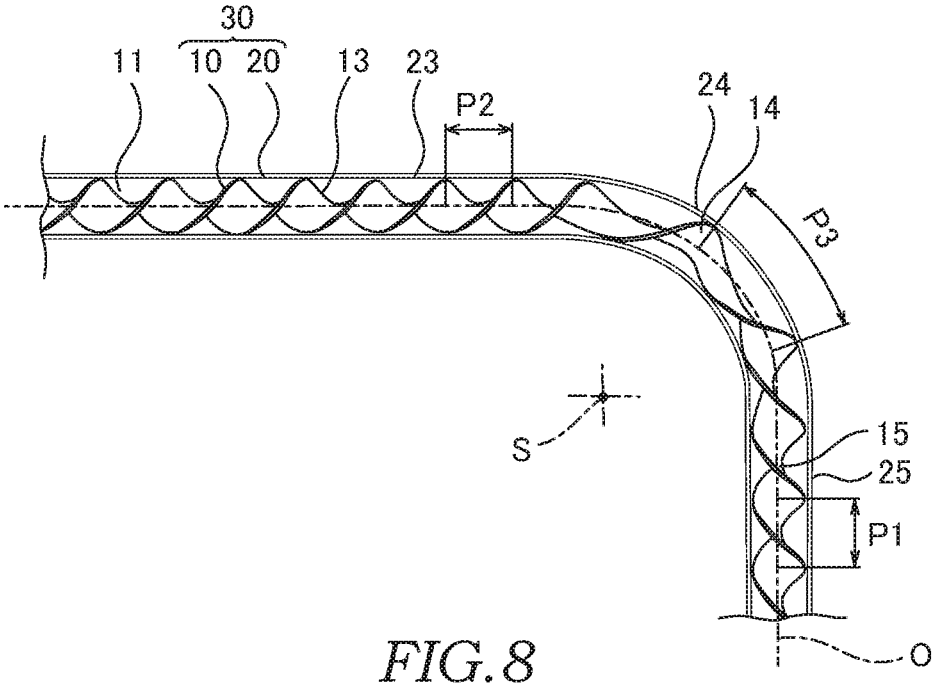
FIG. 8 is a sectional view showing the fin-assembled tube according to a modification.

FIG. 8 is a sectional view showing the fin-assembled tube 30 thus manufactured. The helical fin 10 has a straight fin portion 13 that is arranged in the interior of the straight tube portion 23, a bent fin portion 14 that is arranged in the bent portion 24, and a straight fin portion 15 that is arranged in the interior of the straight tube portion 25.

The straight fin portions 13 and 15 are arranged such that respective center lines extend in a substantially straight line along the axis O of the inner tube 20. Helical pitches P1 and P2 of the straight fin portions 13 and 15 are respectively set arbitrarily.

The center line of the bent fin portion 14 is curved so as to follow the axis O of the inner tube 20. A helical pitch P3 of the bent fin portion 14 is longer than the helical pitches P1 and P2 of the straight fin portions 13 and 15.

As described above, according to this embodiment, in the fin-assembled tube 30, the helical fin 10 is arranged in the interior of the inner tube 20 (tube). The inner tube 20 has the straight tube portions 23 and 25 the center lines of which respectively extend in a substantially straight line and the bent portion 24 the center line of which is curved. The helical pitch P3 of the helical fin 10 extending in the bent portion 24 is configured so as to be longer than the helical pitches P1 and P2 of the helical fin 10 extending in the straight tube portions 23 and 25.

According to the above-described configuration, in the bent portion 24, the helical pitch of the helical fin 10 is set to be longer relative to those of the straight tube portions 23 and 25, and thereby, it is possible to suppress a variation in a flexural rigidity of the helical fin 10. With such a configuration, with the fin-assembled tube 30, effects of the flexural rigidity of the helical fin 10 on the bending process of the inner tube 20 can be suppressed, and thereby, it is possible to increase a forming accuracy of the bent portion 24.

Next, a modification of the fin-assembled tube 30 shown in FIGS. 9 to 11 will be described.

Figure 9:
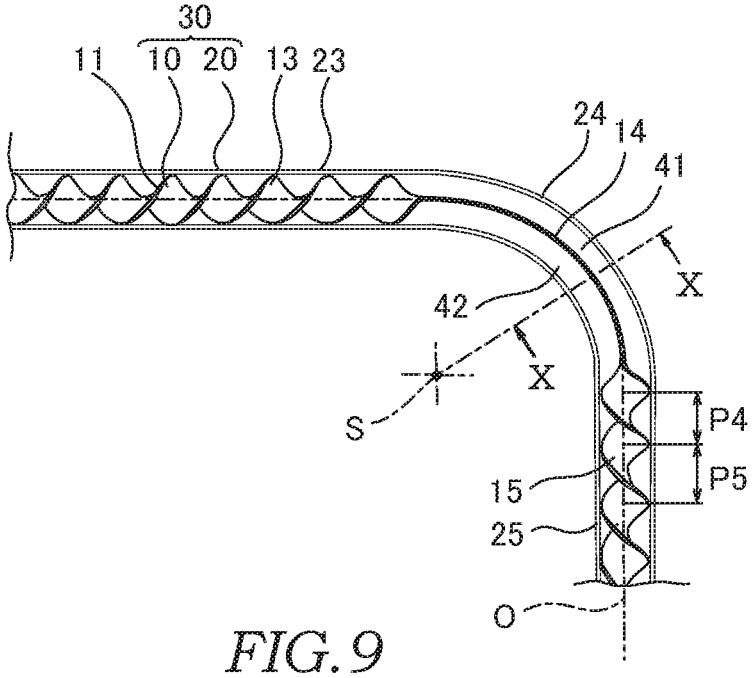
FIG. 9 is a sectional view showing the fin-assembled tube according to another modification.

As shown in FIG. 9, the straight fin portion 15 that is subjected to a processing before the bent fin portion 14 is formed such that a helical pitch P4 of a portion closer to the bent portion 24 is shorter than a helical pitch P5 of another portion away from the bent portion 24. With such a configuration, the helical fin 10 is configured such that the position of the fin material 11 at an end portion of the straight tube portion 25 is adjusted arbitrarily.

The configuration is not limited to the configuration described above, and as shown in FIG. 11, the straight fin portion 15 may be formed such that a helical pitch P6 of the portion closer to the bent portion 24 is longer than a helical pitch P7 of the other portion away from the bent portion 24. With such a configuration, the helical fin 10 is configured such that the position of the fin material 11 at an end portion of the straight tube portion 25 is adjusted arbitrarily.

The straight fin portion 13 is formed such that the helical pitch P1, P2 of the portion closer to the bent portion 24 is longer than that of the other portion away from the bent portion 24. With such a configuration, the helical fin 10 is configured such that the position of the fin material 11 at an end portion of the straight tube portion 23 is adjusted arbitrarily.

As described above, the helical fin 10 is configured such that the positions of the both end portions of the fin material 11 interposed in the interior of the bent portion 24 are set by adjusting the position of the fin material 11 at respective end portions of the straight tube portions 23 and 25.

The bent fin portion 14 is arranged such that the fin material 11 interposed in the interior of the bent portion 24 is substantially in parallel to the bending center axis S. In the bent fin portion 14, the fin material 11 is not twisted about the axis O, and the helical pitch thereof is set to be infinity.

Figure 10:
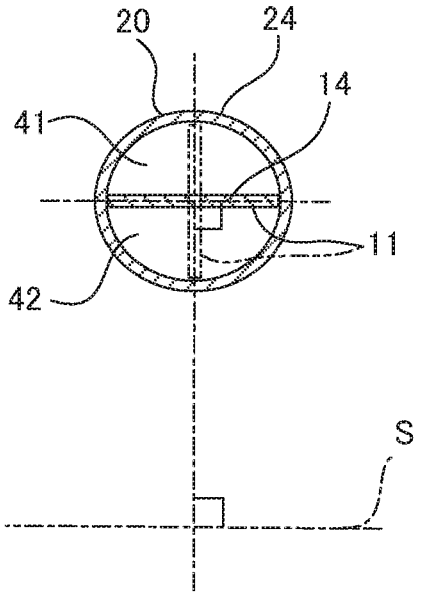
FIG. 10 is a sectional view taken along X-X in FIG. 9.
Figure 11:
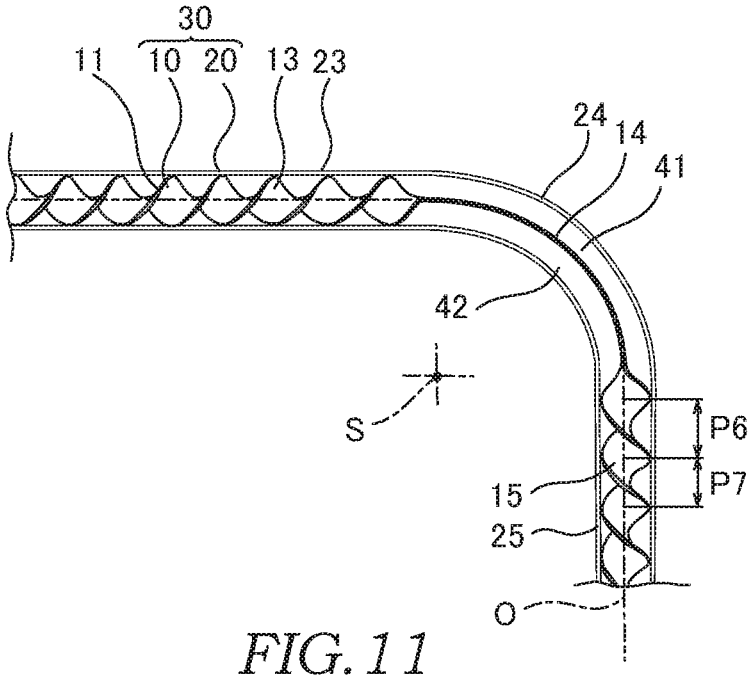
FIG. 11 is a sectional view showing the fin-assembled tube according to further modification.

FIG. 10 is a sectional view of the inner tube 20 (the bent portion 24) and the bent fin portion 14 (the fin material 11) including the bending center axis S. As shown in FIG. 10, the fin material 11 forming the bent fin portion 14 extends substantially in parallel to the bending center axis S.

The bent fin portion 14 extends such that an interior space of the bent portion 24 is partitioned into a radially inside space 41 and a radially outside space 42 with respect to the bending center axis S.

In the bent portion 24, because the fin material 11 extends substantially in parallel to the bending center axis S, the flexural rigidity of the helical fin 10 is minimized. With such a configuration, with the fin-assembled tube 30, the effects of the flexural rigidity of the helical fin 10 on the bending process of the inner tube 20 can be suppressed, and thereby, it is possible to increase the forming accuracy of the bent portion 24.

Note that, as shown with two-dot chain line in FIG. 10, because the fin material 11 is substantially perpendicular to the bending center axis S, the flexural rigidity of the helical fin 10 is maximized, and the forming accuracy of the bent portion 24 is deteriorated.

In order to adapt to the above-described problem, the bent portion 24 may be configured such that the fin material 11 extends so as not to be perpendicular to the bending center axis S. With such a configuration, it is possible to avoid the flexural rigidity of the helical fin 10 from being maximized. Thus, it is possible to increase the forming accuracy of the bent portion 24.

Although the embodiments of the present invention have been described in the above, the above-described embodiments merely illustrate a part of application examples of the present invention, and the technical scope of the present invention is not intended to be limited to the specific configurations in the above-described embodiments.

Although the fin-assembled tube 30 of the above-described embodiment is suitable as a heat exchange tube for forming the heat exchanger, the fin-assembled tube 30 may also be applied to a machine or facilities other than the heat exchanger.

The invention claimed is:

1. A fin-assembled tube comprising a helical fin arranged in an interior of a tube, wherein the tube includes:

a straight tube portion, a center line of which extends in a substantially straight line; and a bent portion, the center line of which is curved, wherein the helical fin is formed by being twisted into a helical shape in an interior of the straight tube portion and in an interior of the bent portion with respect to the tube, the helical fin being formed such that a first helical pitch in an axial direction is longer in a first portion positioned in the bent portion relative to a second helical pitch in a second portion positioned in the straight tube portion, and the first helical pitch and the second helical pitch being pitches of a plate-shaped fin material twisted by a certain angle about the center line, and the helical fin interposed in the straight tub portion has a shorter helical pitch in a portion closer to the bent portion than in a portion away from the bent portion.

2. The fin-assembled tube according to claim 1, wherein the bent portion is bent about a bending center axis, and the helical fin extends such that the plate-shaped fin material is not perpendicular to the bending center axis in the bent portion.

3. A fin-assembled tube comprising a helical fin arranged in an interior of a tube, wherein the tube includes:

a straight tube portion, a center line of which extends in a substantially straight line; and a bent portion, the center line of which is curved, wherein the helical fin is formed by being twisted into a helical shape in an interior of the straight tube portion and in an interior of the bent portion with respect to the tube, the helical fin being formed such that a first helical pitch in an axial direction is longer in a first portion positioned in the bent portion relative to a second helical pitch in a second portion positioned in the straight tube portion, and the first helical pitch and the second helical pitch being pitches of a plate-shaped fin material twisted by a certain angle about the center line, and the helical fin interposed in the straight tube portion has a longer helical pitch in a portion closer to the bent portion than in a portion away from the bent portion.

4. The fin-assembled tube according to claim 3, wherein the bent portion is bent about a bending center axis, and the helical fin extends such that the plate-shaped fin material is not perpendicular to the bending center axis in the bent portion.

* * * * *